US011492179B2

(12) United States Patent
Rognard

(10) Patent No.: US 11,492,179 B2
(45) Date of Patent: Nov. 8, 2022

(54) TAMPER-EVIDENT CLOSURES

(71) Applicant: Obrist Closures Switzerland GmbH, Reinach (CH)

(72) Inventor: Jean-Yves Rognard, Marcy-sur-Anse (FR)

(73) Assignee: Obrist Closures Switzerland GmbH, Reinach (CH)

( * ) Notice: Subject to any disclaimer, the term of this patent is extended or adjusted under 35 U.S.C. 154(b) by 462 days.

(21) Appl. No.: 15/769,845

(22) PCT Filed: Oct. 21, 2016

(86) PCT No.: PCT/EP2016/075443

§ 371 (c)(1),
(2) Date: Apr. 20, 2018

(87) PCT Pub. No.: WO2017/068151

PCT Pub. Date: Apr. 27, 2017

(65) Prior Publication Data

US 2018/0312305 A1 Nov. 1, 2018

(30) Foreign Application Priority Data

Oct. 22, 2015 (GB) ..... 1518770.1

(51) Int. Cl.

| | |
|---|---|
| ***B65D 41/34*** | (2006.01) |
| ***B65D 47/08*** | (2006.01) |
| ***B65D 55/02*** | (2006.01) |

(52) U.S. Cl.

CPC ..... *B65D 41/3428* (2013.01); *B65D 47/0838* (2013.01); *B65D 47/0852* (2013.01); *B65D 55/024* (2013.01)

(58) Field of Classification Search

CPC ..... B65D 47/243; B65D 47/0838; B65D 47/0852; B65D 41/3428; B65D 2401/15;

(Continued)

(56) References Cited

U.S. PATENT DOCUMENTS 4,801,030 A 1/1989 Barriac
5,853,095 A * 12/1998 Marshall ..... B65D 41/3428 215/252

(Continued)

FOREIGN PATENT DOCUMENTS

| | | | |
|---|---|---|---|
| EP | 1953091 | A1 | 8/2008 |
| WO | 2015121177 | A1 | 8/2015 |
| WO | 2015162128 | A1 | 10/2015 |

OTHER PUBLICATIONS

Jan. 23, 2017—(WO) International Search Report and Written Opinion—App PCT/EP2016/075443.

*Primary Examiner* — Charles P. Cheyney
(74) *Attorney, Agent, or Firm* — Banner & Witcoff, Ltd.

(57) ABSTRACT

A tamper-evident closure for a container is provided. The closure comprises a base attachable to a container neck. The base comprises a sidewall having a tamper-evident drop band, the band including an abutment for engaging the container neck to cause the band to break away from the sidewall if an attempt is made to remove the closure from the neck once fitted. The band further comprises an extension against which the sidewall pushes if the closure is reapplied to push the band away from the base. The extension extends only part of the way around the band.

21 Claims, 12 Drawing Sheets

(58) Field of Classification Search
CPC ..... B65D 2401/25; B65D 2401/20; B65D 2401/30; B65D 41/3447; B65D 2251/0015
USPC ..... 222/153.06, 153.07, 541.6, 525; 215/252, 253, 256, 258
See application file for complete search history.

(56) References Cited

U.S. PATENT DOCUMENTS

| | | | | | |
|---|---|---|---|---|---|
| 6,006,932 | A * | 12/1999 | Morini | B65D 51/002 | 215/204 |
| 6,382,444 | B1 * | 5/2002 | Nyman | B65D 41/0471 | 215/218 |
| 6,942,114 | B2 * | 9/2005 | Nishida | B65D 41/3438 | 215/252 |
| 7,059,485 | B1 * | 6/2006 | Reidenbach | B65D 41/3428 | 215/252 |
| 7,222,741 | B2 * | 5/2007 | Chmela | B65D 55/0863 | 220/257.1 |
| 7,513,377 | B1 * | 4/2009 | Culley | B65D 41/3428 | 215/252 |
| 7,527,161 | B2 * | 5/2009 | Rodriguez | B65D 41/3419 | 215/252 |
| 8,763,830 | B2 * | 7/2014 | Sadiq | B65D 41/04 | 215/252 |
| 9,598,200 | B2 * | 3/2017 | Lee | B65D 45/325 | |
| 10,214,325 | B2 * | 2/2019 | Rognard | B65D 47/0852 | |
| 10,351,315 | B2 * | 7/2019 | Berge | B65D 47/122 | |
| 2005/0173367 | A1 * | 8/2005 | Nusbaum | B65D 47/0842 | 215/237 |

* cited by examiner

TAMPER-EVIDENT CLOSURES

Application PCT/EP2016/075443 claims priority from Application 1518769.3 filed on Oct. 22, 2015 in the United Kingdom. Application PCT/EP2016/075443 claims priority from Application 1518770.1 filed on Oct. 22, 2015 in the United Kingdom. The entire contents of these applications are incorporated herein by reference in their entirety.

The present invention relates generally to closures and particularly to tamper-evident closures having a mechanism for informing a user if a closure has been opened/accessed at least once.

The present invention relates to a tamper-evident system for ensuring that a tamper-evidencing event is shown clearly; that there is a strong visual difference between the initial, unopened condition and the condition after tamper-evidencing has been activated.

According to an aspect of the present invention there is provided a tamper-evident closure for a container, the closure comprising a base attachable to a container neck, the base comprising a sidewall having a tamper-evident drop band, the band including an abutment for engaging the container neck to cause the band to break away from the sidewall if an attempt is made to remove the closure from the neck once fitted, the band further comprising an extension against which the sidewall pushes if the closure is reapplied to push/keep at least part of the band away from the base, in which the extension extends only part of the way around the band so as to be arranged asymmetrically thereon.

In use, in an unopened position the extension may arranged between the sidewall and a container neck abutment bead against which the band abutment bears upon opening.

The sidewall may comprise an internal bead for pushing the extension in the reapplied position.

Part of the extension may be initially located above the bead and is pulled down over the bead upon removal of the closure, and thereafter cannot pass back over the bead.

The internal bead may be continuous or discontinuous.

The extension may comprise a plurality of flaps.

The extension may extend around only part of the band. For example, one or more flaps may be provided around only part of the band; for example the flap coverage may be asymmetric. In some embodiments flap/s are restricted to a sector/circumferential length of a generally circular band. This might mean, for example, that part of the band is kept away from the skirt by the extension (whilst part of the band moves back to or towards the base).

The band may be pushed so that it pressed towards or against a container neck transfer bead.

The band may be frangibly connected to a free end of the sidewall.

The closure may further comprise other parts, such as a lid.

The lid may be hingedly connected to the base. The closure may therefore be formed as a flip top closure.

There may be provided a tamper-evident means for indicating if the lid has been opened, such as a tear-off tab, strip or the like. In some embodiments the tamper-evident means comprises two rings which are frangibly connected together and which are pulled apart upon first opening of the lid. In some embodiments one of the ring remains in the lid and the other drops onto/into the base.

The closure may comprise a dispensing member such a spout. The spout may be formed separately of the base, or may be provided as an integral part of the base.

The member may comprise a self-closing valve.

The base may be screw threadable onto a neck. Other forms of connection may be used, such as a snap bead or the like.

The band may comprise anti-rotation means for improving breakage.

The closure may comprise a tamper-evident drop band frangibly attached to the free end of a closure side skirt forming part of a main body. The drop band may be formed so that if the closure is removed and then replaced the main body pushes down onto part of the band.

The drop band may comprise a folded band including the abutment and the extension.

The band may be formed with the flap in an unfolded position. For example the closure may be moulded from a thermoplastics material such as polyethylene or polypropylene with the flap in an unfolded position (for example extending "downwards" away from a lid). The flap is then folded "up" either in the mould or in a post-moulding operation so as to extend towards a lid.

In some embodiments the part of the band which is pushed away by the body is a flap. This ensures that there is a clear gap between the free end of the side skirt and the band. The free end of the flap has a generally triangular geometry.

In some embodiments the base can push the band down until it contacts a container neck transfer bead or the like.

In some embodiments the body is provided with a bead or the like which pushes the band.

A further aspect provides a flip-top sportscap for a container neck, the sportscap comprising a screw-threaded base and a lid joined by a hinge, the base comprising a sidewall at the free end of which a tamper-evident drop-band is frangibly connected, the drop band comprising a folded flap having a part which engages a container neck in use and causes the band to break away from the sidewall if the base is unscrewed, the flap further comprising an extended free end and the sidewall comprising an abutment bead, the bead abutting against the free end of the band to push the band away from the free end of the sidewall if the base is re-screwed onto the neck, in which the extended free end of the folded flap extends only part of the away therearound so as to be arranged asymmetrically thereon.

A further aspect provides a tamper-evident flip-top closure comprising a base a lid joined by a hinge, and a tamper-evident member in the form of two rings frangibly connected together, on first opening of the closure the rings are pulled apart so that a first ring is retained by the lid and a second ring is retained by the base, in which the interior of the lid is provided with one or more ribs for preventing access to the first ring in the unopened position.

Upon first opening the second ring may fall into a pocket or void provided in the base so as to become at least partly hidden from view.

The base may comprise a sidewall at the free end of which a tamper-evident drop-band is frangibly connected, the drop band comprising a folded flap having a part which engages a container neck in use and causes the band to break away from the sidewall if the base is unscrewed, the flap further comprising an extended free end and the sidewall comprising an abutment bead, the bead abutting against the free end of the band to push the band away from the free end of the sidewall if the base is re-screwed onto the neck, in which the extended free end of the folded flap extends only part of the away therearound so as to be arranged asymmetrically thereon.

The present invention also provides a container fitted with a closure as described herein.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings, in which:

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Figure 1:
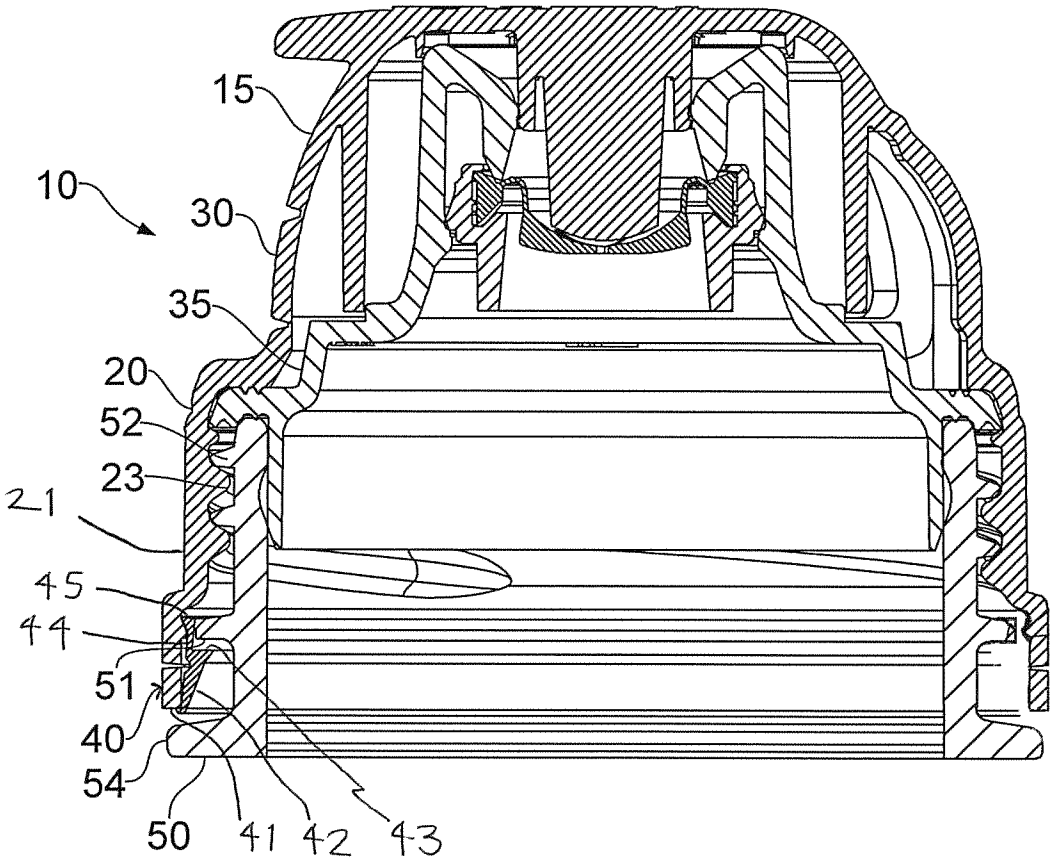
FIG. 1 shows a flip-top (sportscap) tamper-evident closure.

Referring first to FIG. 1 there is shown a flip-top (sportscap) tamper-evident closure 10. The closure 10 includes a lid 15 connected to a base 20 by a hinge 25.

A tamper-evident strip 30 is provided to connect the lid 15 and the base 20 and must be torn off to allow the lid to be opened to reveal a drinking spout 35.

The base 20 includes a sidewall 21 and at the free end of the sidewall is a tamper-evident drop band 40.

The drop band 40 includes an annular band 41 frangibly connected to the free end of the sidewall 21 by frangible bridges 46, and a folded flap 42 that extends radially inwardly of the band.

The flap 42 includes an abutment surface 43 which engages under a tamper bead 51 of a container neck finish 50 and ensures that if the sidewall lifts (if an attempt is made to unscrew the closure) the drop band 40 is broken away from the sidewall 21 because the abutment surface 43 cannot pass over the bead 51.

Beyond the flap abutment surface 43 the flap 42 has an extension part 44 that terminates with a terminal part 45 with a generally triangular geometry. In the unopened position the part 45 rests on a bead 22 formed on the interior of the sidewall 21, towards its free end.

Figure 2B:
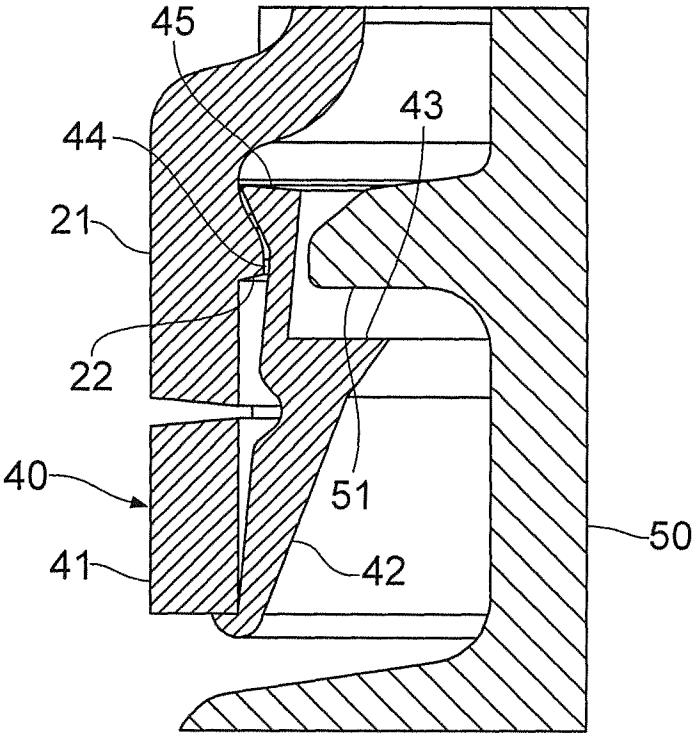
FIGS. 2A and 2B show the closure of FIG. 1 in an unopened condition.
Figure 2A:
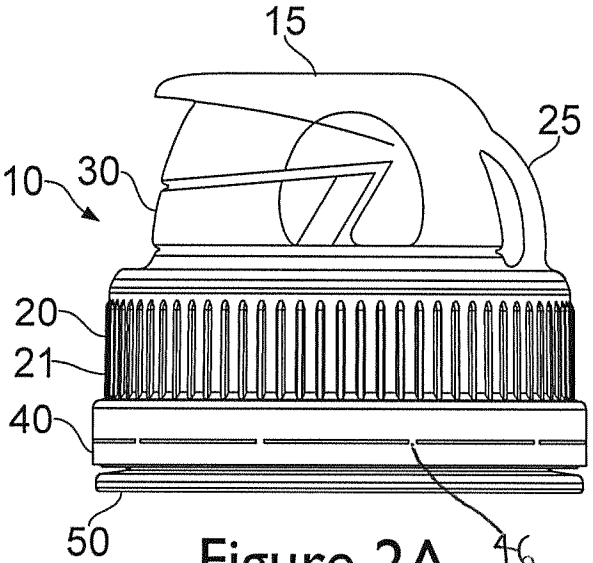

FIGS. 2A and 2B show the closure in an unopened condition. The abutment surface 43 sits just underneath the bead 51, the extension part 44 extends between the bead 22 and the bead 51, and the part 45 rests on the sidewall bead 22.

If the base 20 is unscrewed from the neck 50 firstly the sidewall 21 will move axially upwards, initially taking the band 40 with it until the abutment surface 43 contacts the underside of the bead 51. At that point the band 40 cannot move any further axially. Continued axial movement of the sidewall causes the frangible bridges to break and the band 40 separates from the sidewall 21.

Figure 3:
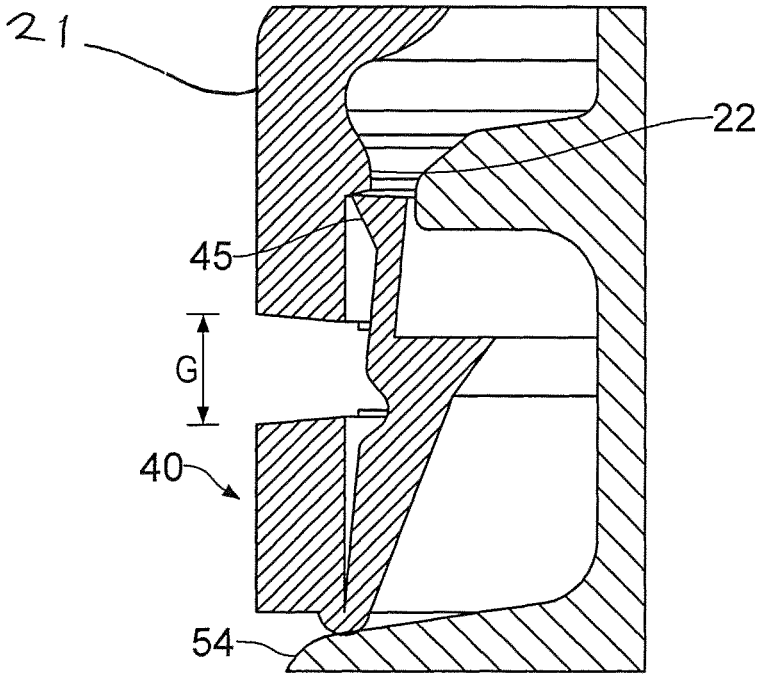
FIG. 3 shows the closure of FIGS. 1 and 2 when opened and screwed back down.
Figure 4:
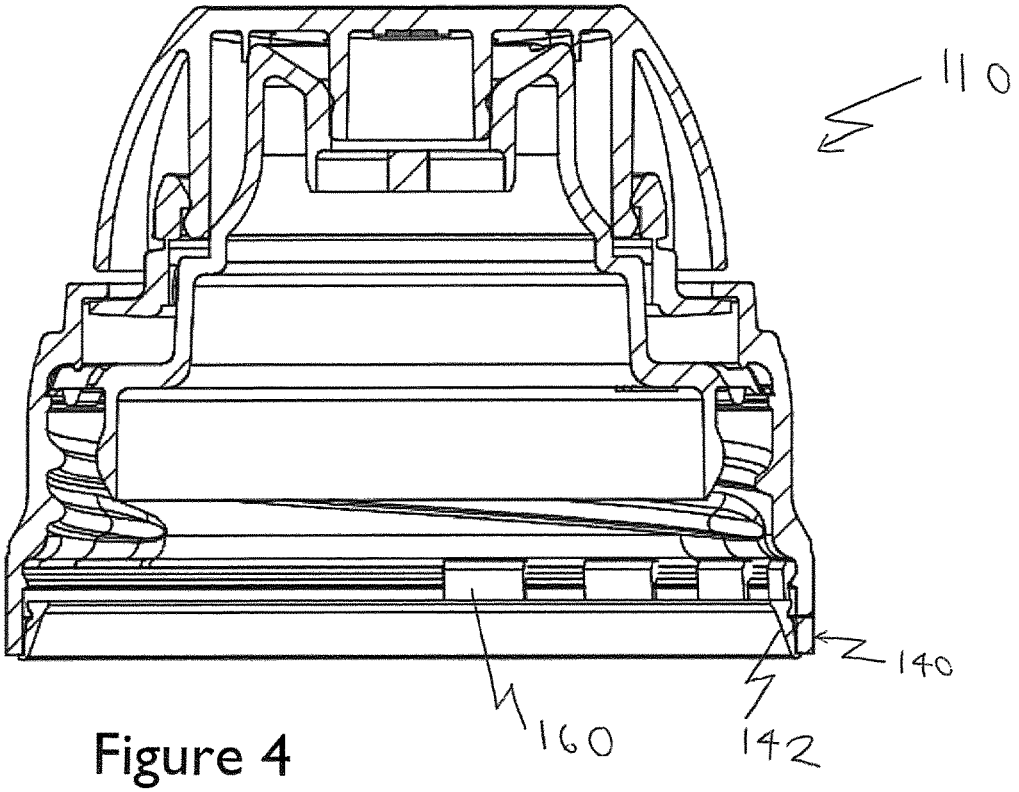
FIGS. 4 to 7 show a closure formed according to a further embodiment.
Figure 5:
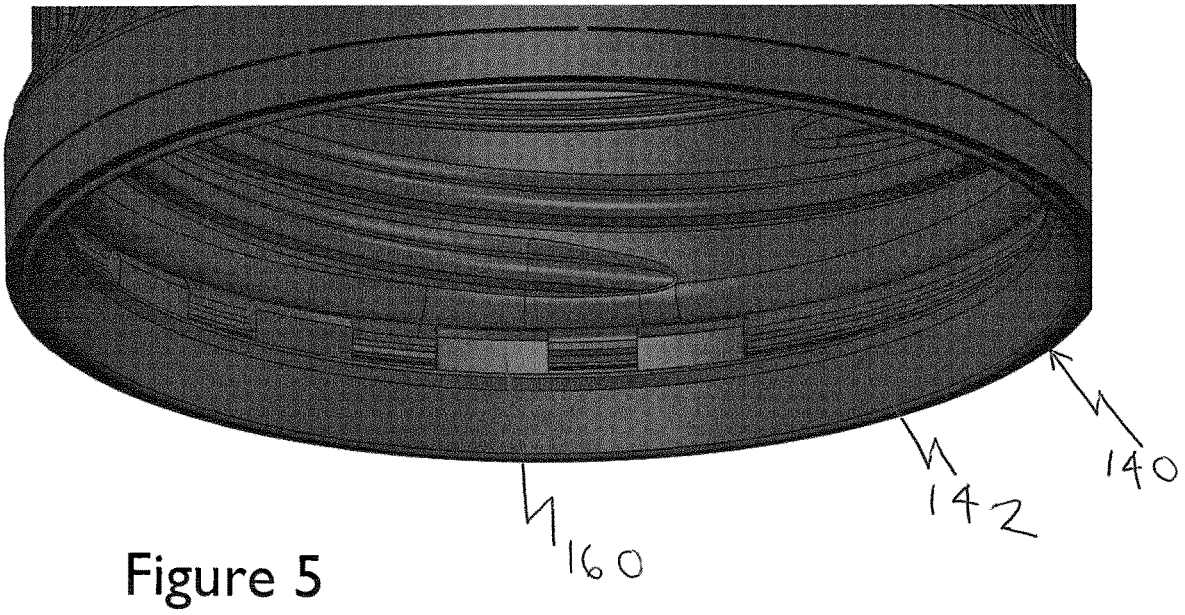
Figure 7:
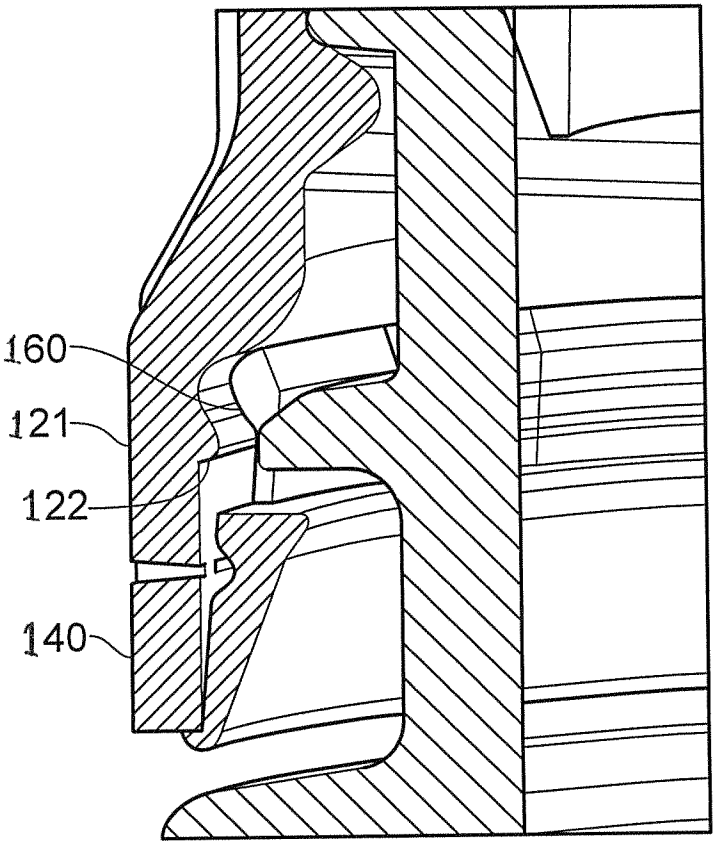
Figure 6:
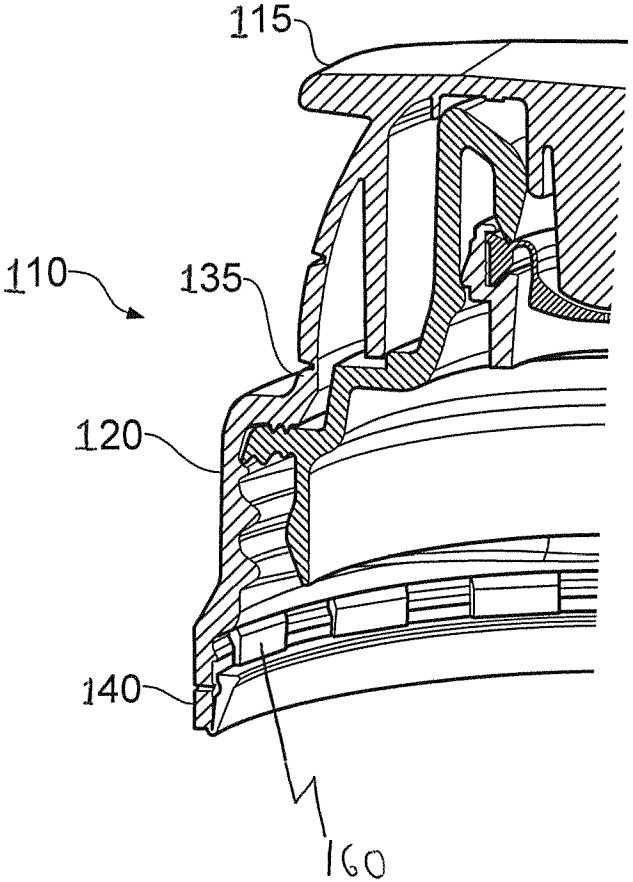

As illustrated in FIG. 3, if the closure is screwed back down, the sidewall bead 22 pushes down on the terminal part 45 of the band flap extension 43 and this pushes the band 40 down, to form/maintain a gap G.

By using the closure base to push down on the folded flap part of the drop band this ensures that there is a clear gap between the free end of the sidewall and the broken away drop band. In this embodiment the base 20 pushes the band 40 down until it abuts against the neck bead 51.

If the band has already dropped the gap G is maintained; if the band remains on the bead then it is pushed off the bead and down away from the sidewall as the closure is reapplied.

In order to prevent the above tamper-evidence principle being circumvented, the present invention looks at the possibility of the band being completely removed and re-fitted into the closure base.

FIGS. 4 to 7 show a closure 110 formed according to a further embodiment. In this closure the extension part extends around only part of the folded flap 142 and is in the form of four spaced flaps 160. The flaps 160 are formed like hooks.

The four hooks 160 are spaced but clustered in a radial segment of the annular flap 142, which means that collectively they are arranged asymmetrically on the circumference of the flap.

This means that the hook features extend around only part of the band 140. The functionality of pushing the band away is retained, whilst it is no longer possible to re-fit the band into the skirt.

Figure 8:
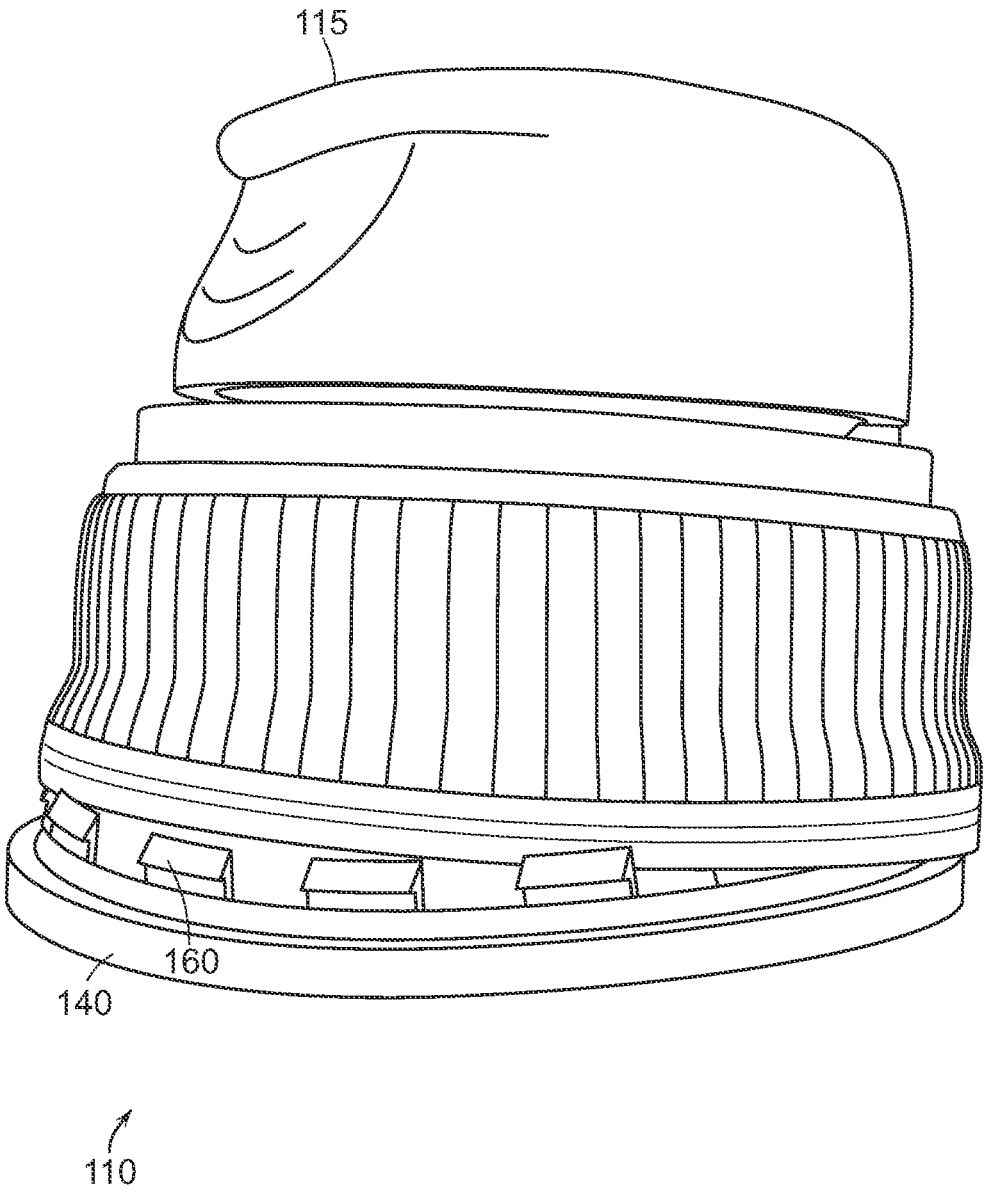
FIG. 8 shows the closure of FIGS. 4 to 7 in use.

FIG. 8 shows the closure 110 in use. When we open and reclose the cap the tamper evident 140 is push down by the cap, and shown a visual difference versus the previous stage. The pushing down effect is, of course, restricted to the radial segment in which the flaps 160 are provided, so the band 140 is only pushed down over part of its circumference, as shown in the Figure.

Figure 9:
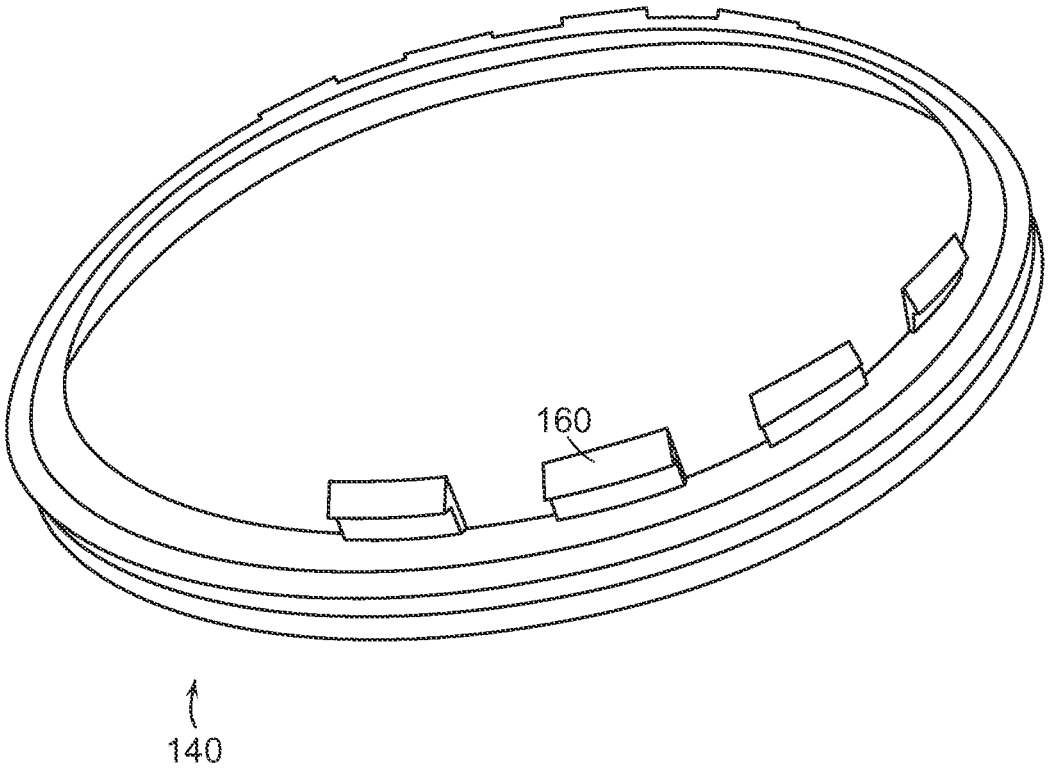
Figure 10:
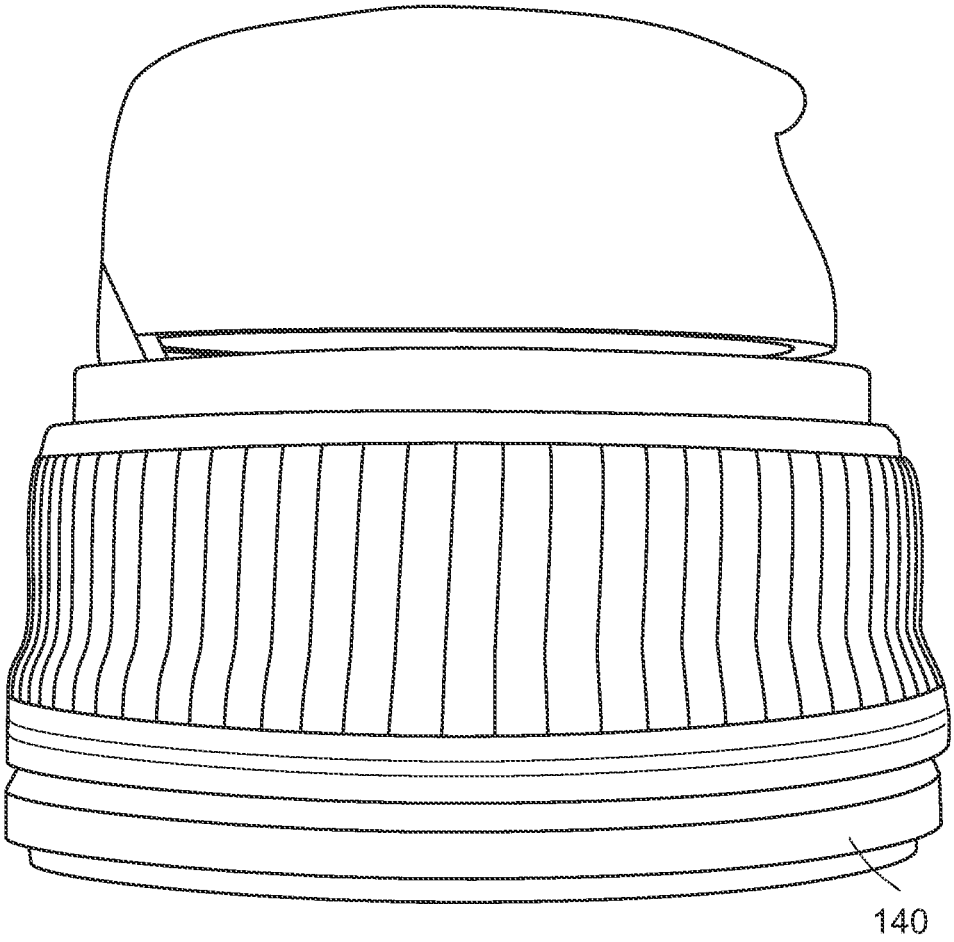

And if people want to release the tamper evident band from the neck (FIG. 9) and then put it back inside the cap, this tamper evident band doesn't stay inside the cap properly; we have a "smiley" effect (FIG. 10) and we could see a difference before and after opening (less visible, but still different). This is because once the frangible bridges have been broken between the band and the sidewall the four flaps 160 don't' provide enough retaining force to keep the band 140 completely in the closure.

In some embodiments the present invention utilises a folded band. Hook features may be used in order to provide the benefit of pushing the band away from the free end of the closure skirt after first opening.

Figure 11:
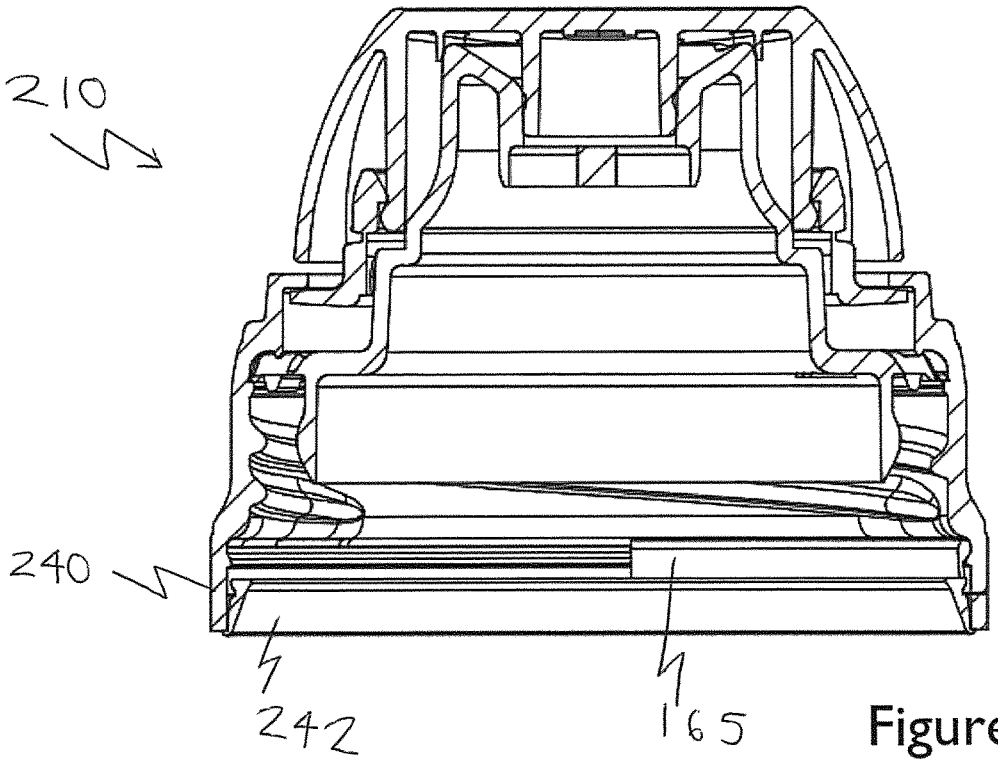
FIGS. 11 and 12 show a closure formed according to a further embodiment.
Figure 12:
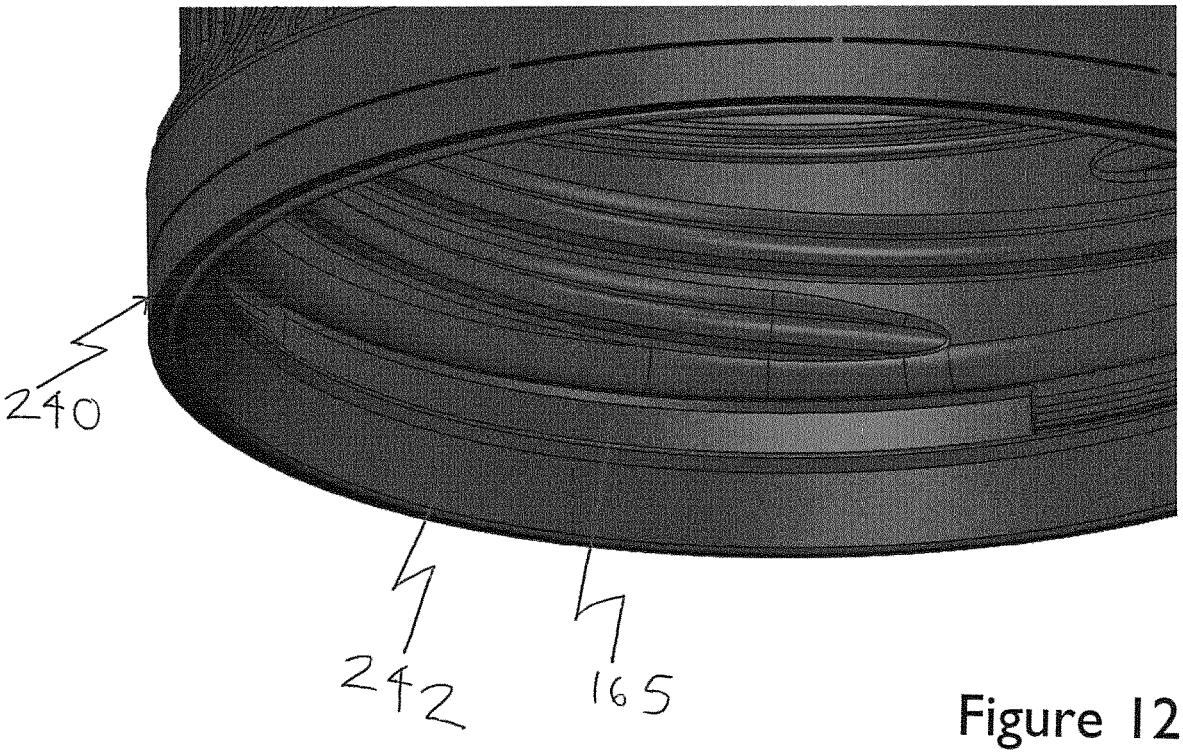

FIGS. 11 and 12 show a closure 210 formed according to a further embodiment. In this embodiment the radially restricted and asymmetrically arranged extension feature is not spaced flaps but a single arcuate flap 165.

Figure 13:
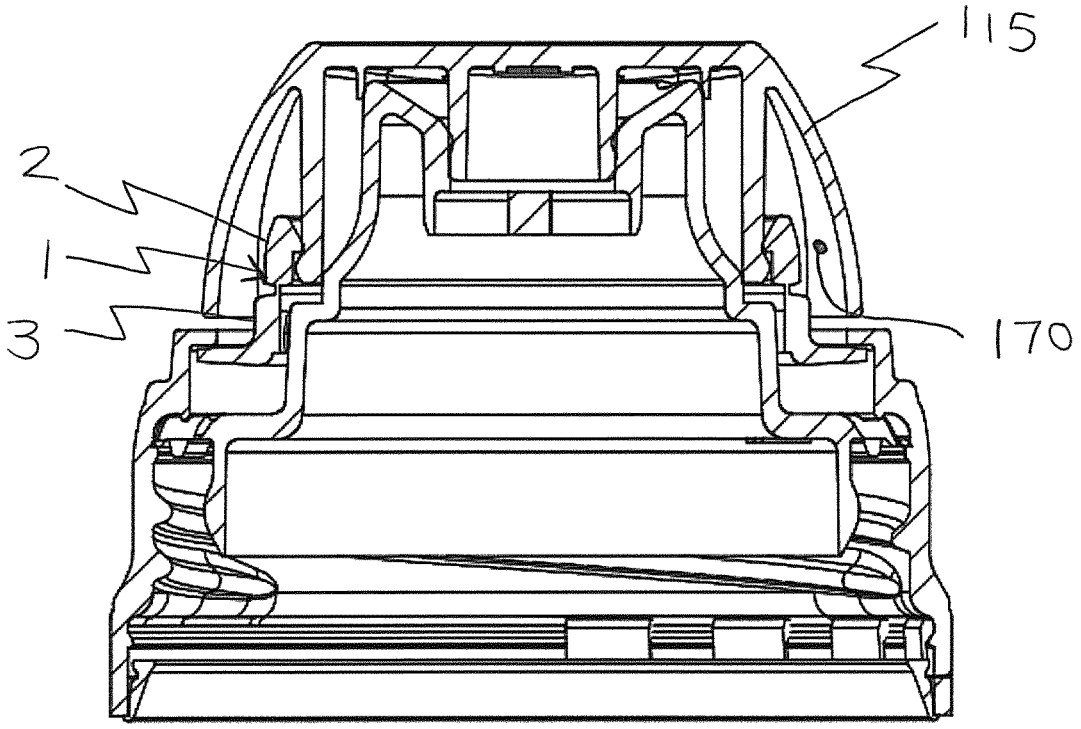
FIGS. 13 to 15 show a closure formed according to yet another embodiment.
Figure 14:
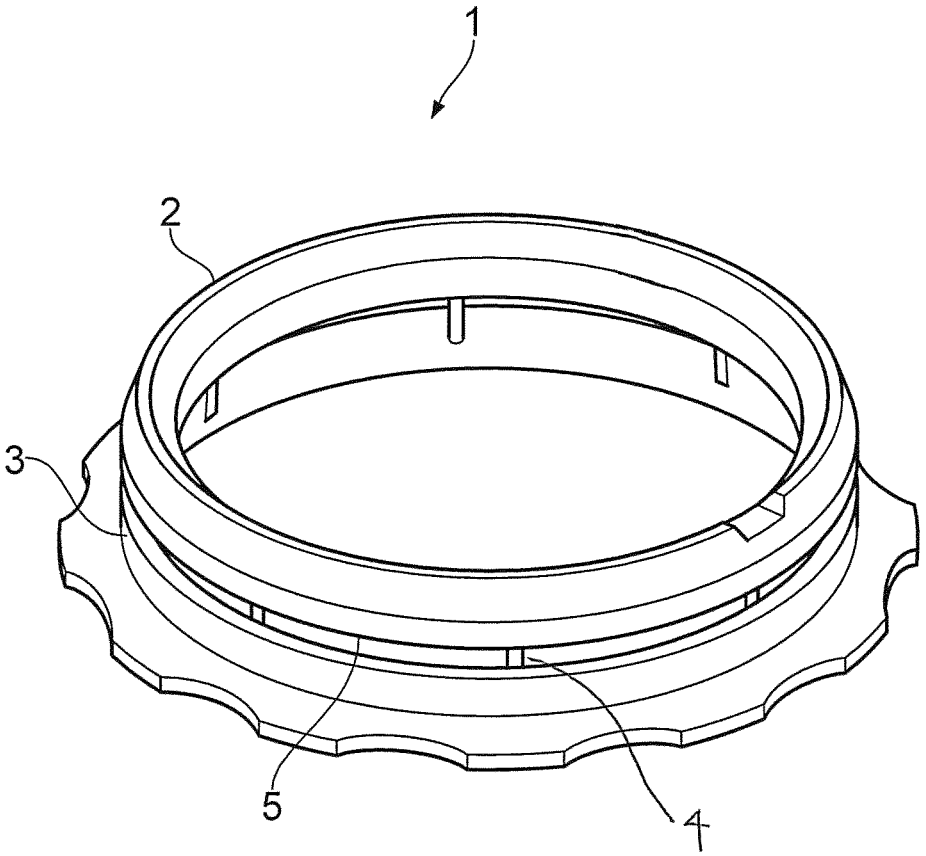
Figure 15:
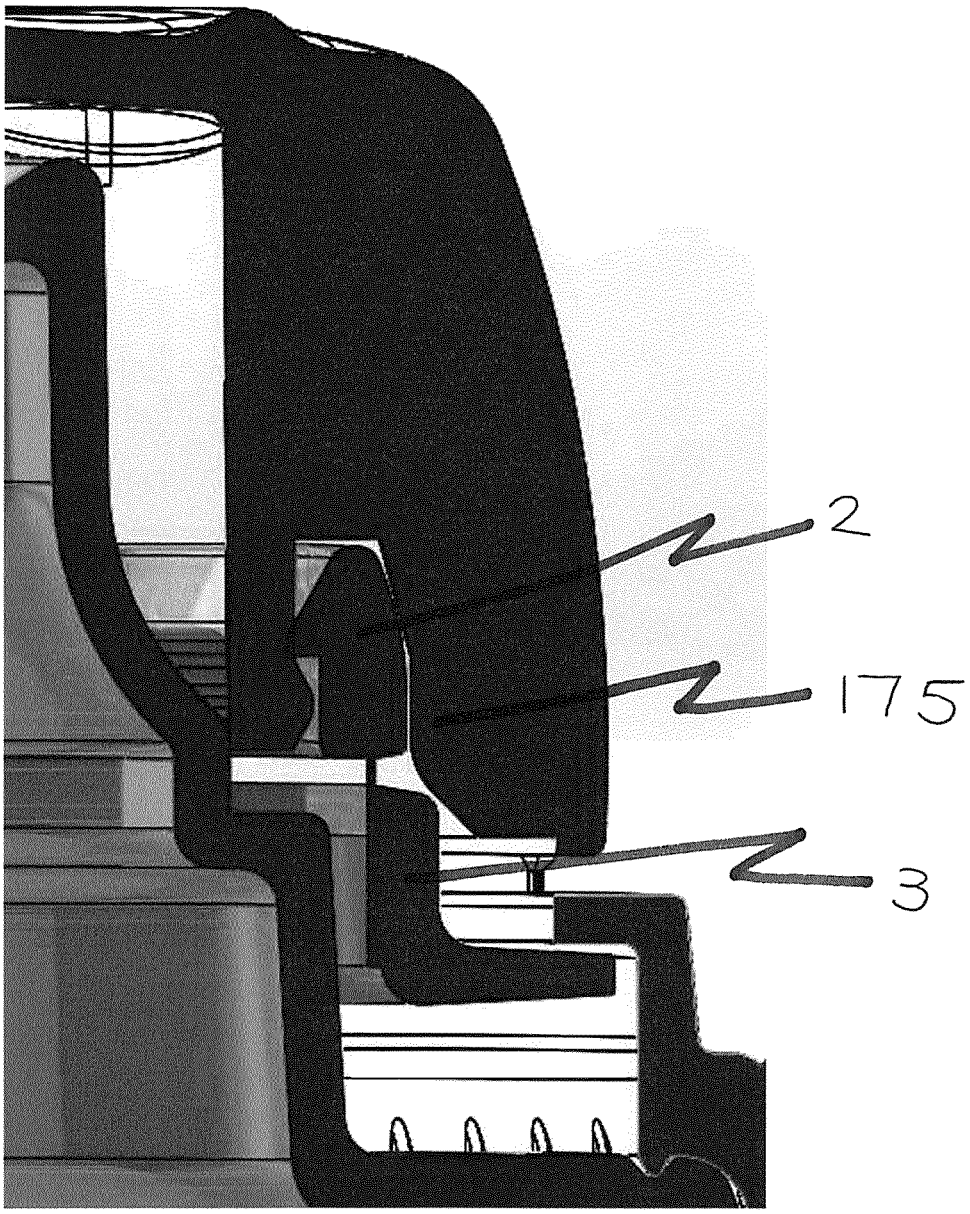

A further aspect of the present invention is described in relation to FIGS. 13 to 15.

In FIG. 13 a closure 110 of the general type discussed above is shown. FIG. 14 shows a double ring tamper-evident member 1 of the general type fitted into the closure 110.

The inventors have noticed that the space 170 between the lid 115 and the double ring tamper-evident member 1 may provide an opportunity for levering or otherwise causing the upper ring 2 to be moved away from the lid without causing the frangible bridges 4 between the rings 2, 3 to rupture. This would allow the lid to be lifted and then replaced without separating the rings, thus defeating this tamper-evident feature.

As shown in FIG. 15, in order to restrict access to the member 1, one or more ribs 175 are provided on the interior of the lid and extend radially inwards and into the space between the lid and the ring 2 to restrict access.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A tamper-evident closure for a container, the closure comprising a base attachable to a container neck, the base comprising a sidewall having a tamper-evident drop band encircling the container neck, the band including an abutment for engaging the container neck to cause the band to break away from the sidewall during removal of the sidewall from the neck once fitted and to remain encircling the container neck, the band further comprising an extension against which the sidewall pushes during subsequent reapplication of the sidewall so as to push the band away and thereby maintain a gap between the sidewall and band only at a first portion of the band, the extension extends along a radial segment that defines only a portion of a circumference of the band and corresponds to the first portion of the band, such that during reapplication of the sidewall after the band is broken away only the first portion of the band is pushed away from the base such that the band is orientated at an oblique angle at the first portion of the band so as to provide evidence of tampering.

2. A closure as claimed in claim 1, in which, in use, in an unopened position the extension is arranged between the sidewall and a container neck abutment bead against which the band abutment bears upon opening.

3. A closure as claimed in claim 1, in which the sidewall comprises an internal bead for pushing the extension in the reapplied position.

4. A closure as claimed in claim 3, in which part of the extension is initially located above the bead and is pulled down over the bead upon removal of the closure, and thereafter cannot pass back over the bead.

5. A closure as claimed in claim 3, in which the internal bead is continuous or discontinuous.

6. A closure as claimed in claim 1, in which the extension comprises one or a plurality of flaps.

7. A closure as claimed in claim 1, in which the band is pushed so that it pressed against a container neck transfer bead.

8. A closure as claimed in claim 1, in which the band is frangibly connected to a free end of the sidewall.

9. A closure as claimed in claim 1, in which the drop band comprises a folded flap including the abutment and the extension.

10. A closure as claimed in claim 9, in which the band is formed with the flap in an unfolded position.

11. A closure as claimed in claim 1, in which the closure further comprises a lid which is hingedly connected to the base.

12. A closure as claimed in claim 1, in which the base comprises a spout.

13. A closure as claimed in claim 12, in which the spout comprises a self-closing valve.

14. A closure as claimed in claim 1, in which the base is screw threadable onto a neck.

15. A closure as claimed in claim 1, in which the band comprises anti-rotation means for improving breakage.

16. A flip-top sportscap for a container neck, the sportscap comprising a screw-threaded base and a lid joined by a hinge, the base comprising a sidewall at a free end of which a tamper-evident drop-band encircling the container neck is frangibly connected, the drop band comprising a folded flap having a part which engages a container neck in use and causes the band to break away from the sidewall during unscrewing of the base and to remain encircling the container neck, the flap further comprising an extended free end and the sidewall comprising an abutment bead, the bead abutting against the free end of the band to push the band away from the free end of the sidewall during rescrewing of the base onto the neck and thereby maintain a gap between the sidewall and the band only at a first portion of the band, in which the extended free end of the folded flap extends along a radial segment that defines only a portion of a circumference of the band and corresponds to the first portion of the band, such that during reapplication of the sidewall after the band is broken away only the first portion of the band is pushed away from the base such that the band is orientated at an oblique angle at the first portion of the band so as to provide evidence of tampering.

17. A container fitted with a closure as claimed in claim 1.

18. A closure as claimed in claim 1, in which the base is formed as a cap.

19. A closure as claimed in claim 1, in which the closure includes a lid and a base, the lid being connected to the base by a hinge.

20. A closure as claimed in claim 12, in which the spout is formed separately of the base.

21. A closure as claimed in claim 12, in which the spout is provided as an integral part of the base.

* * * * *